US009797188B2

(12) United States Patent
Rettig

(10) Patent No.: US 9,797,188 B2
(45) Date of Patent: Oct. 24, 2017

(54) RAIL RETENTION SYSTEM FOR A CORDLESS WINDOW SHADE

(71) Applicant: Springs Window Fashions, LLC, Middleton, WI (US)

(72) Inventor: Dirk Jeremy Rettig, Middleton, WI (US)

(73) Assignee: SPRINGS WINDOW FASHIONS, LLC, Middleton, WI (US)

( * ) Notice: Subject to any disclaimer, the term of this patent is extended or adjusted under 35 U.S.C. 154(b) by 0 days.

(21) Appl. No.: 15/013,505

(22) Filed: Feb. 2, 2016

(65) Prior Publication Data

US 2016/0222721 A1 Aug. 4, 2016

Related U.S. Application Data

(60) Provisional application No. 62/110,956, filed on Feb. 2, 2015.

(51) Int. Cl.

| | |
|---|---|
| ***E06B 9/266*** | (2006.01) |
| ***E06B 9/262*** | (2006.01) |
| ***E06B 9/32*** | (2006.01) |
| *E06B 9/322* | (2006.01) |

(52) U.S. Cl.

CPC ..... *E06B 9/266* (2013.01); *E06B 9/262* (2013.01); *E06B 9/32* (2013.01); *E06B 2009/2627* (2013.01); *E06B 2009/3225* (2013.01)

(58) Field of Classification Search

CPC . E06B 9/266; E06B 9/03; E06B 9/262; E06B 9/323; E06B 2009/3225; E06B 2009/26272

See application file for complete search history.

(56) References Cited

U.S. PATENT DOCUMENTS

| | | | |
|---|---|---|---|
| 4,733,711 | A | 3/1988 | Schon |
| 5,117,893 | A | 6/1992 | Morrison et al. |
| 5,328,113 | A | 7/1994 | de Chevron Villette et al. |
| 5,341,864 | A | 8/1994 | Rupel et al. |
| 5,357,712 | A | 10/1994 | Streeter |
| 6,705,379 | B1 | 3/2004 | Nien |
| 6,968,885 | B2 | 11/2005 | Nien |
| 7,063,122 | B2 | 6/2006 | Colson et al. |
| 7,143,802 | B2 | 12/2006 | Strand et al. |
| 7,740,045 | B2 | 6/2010 | Anderson et al. |

(Continued)

FOREIGN PATENT DOCUMENTS

| | | |
|---|---|---|
| DE | 20/2007010768 | 12/2007 |
| DE | 20/2013000031 | 1/2013 |
| DE | 202014104193 | 9/2014 |

OTHER PUBLICATIONS

EP16153897.0 Extended European Search Report dated Jul. 7, 2016 (7 pages).

*Primary Examiner* — Blair M Johnson

(74) *Attorney, Agent, or Firm* — Michael Best & Friedrich LLP

(57) ABSTRACT

A covering for an architectural opening includes a first rail, a second rail adjustably connected to the first rail, and a magnetic retention assembly configured to removably connect the first and second rails. The magnetic retention assembly includes a magnet coupled to one of the first rail or the second rail, and a receiver coupled to the other of the second rail or the first rail, the receiver configured to form a magnetic connection with the magnet.

19 Claims, 5 Drawing Sheets

(56) References Cited

U.S. PATENT DOCUMENTS

| | | | | |
|---|---|---|---|---|
| 8,118,077 | B2 | 2/2012 | Pflieger | |
| 8,230,896 | B2 | 7/2012 | Anderson et al. | |
| 8,347,937 | B2 | 1/2013 | Murphy | |
| 8,522,852 | B2 | 9/2013 | Yu et al. | |
| 8,573,281 | B2 | 11/2013 | Drew et al. | |
| 8,763,673 | B2 | 7/2014 | Jelic et al. | |
| 8,905,114 | B1 | 12/2014 | Whitaker | |
| 2009/0014133 | A1* | 1/2009 | Lin | E06B 9/262 160/181 |
| 2011/0120823 | A1 | 5/2011 | Hansen et al. | |
| 2012/0234502 | A1 | 9/2012 | Chen | |
| 2012/0267060 | A1 | 10/2012 | Anderson et al. | |
| 2013/0087296 | A1* | 4/2013 | Mullet | E06B 9/262 160/340 |
| 2013/0233499 | A1 | 9/2013 | Wu | |
| 2014/0014279 | A1 | 1/2014 | Defenbaugh et al. | |
| 2014/0076504 | A1 | 3/2014 | Anthony et al. | |
| 2016/0123074 | A1* | 5/2016 | Anderson | E06B 9/38 160/368.1 |
| 2016/0130867 | A1* | 5/2016 | Cheng | E06B 9/38 160/181 |
| 2016/0222721 | A1* | 8/2016 | Rettig | E06B 9/266 |

* cited by examiner

RAIL RETENTION SYSTEM FOR A CORDLESS WINDOW SHADE

CROSS-REFERENCE TO RELATED APPLICATIONS

This application claims priority to U.S. Provisional Patent Application No. 62/110,956, filed on Feb. 2, 2015, and entitled "Mid-Rail Retention System for a Bottom-Up Top-Down Cordless Window Shade," the contents is hereby incorporated by reference in its entirety.

FIELD OF THE INVENTION

The present invention relates to a covering for an architectural opening, and more specifically to a retention system configured to selectively retain a rail of a cordless window shade.

BACKGROUND

It should be appreciated that a "cordless" shade generally refers to a shade that is positioned (or repositioned) by manually adjusting one or more rails, instead of adjusting rail position by a drawstring (or a draw cord). A "cordless" shade does not require that all cords associated with the shade be eliminated, as a "cordless" shade can include, for example, lift cords that extend between rails.

The positioning of a cordless shade is manually adjusted by a user. Certain cordless shades include a plurality of rails that move independently or together relative to a head rail. In certain conditions, it is desirable to maintain a connection between an intermediate rail and the head rail while the user adjusts a bottom rail. In other conditions, it is desirable to allow the connection between the intermediate rail and the head rail to be selectively disengaged by the user so the user can adjust both the intermediate rail and the bottom rail.

SUMMARY

The invention provides, in one aspect, a covering for an architectural opening includes a first rail, a second rail adjustably connected to the first rail, and a magnetic retention assembly configured to removably connect the first and second rails. The magnetic retention assembly includes a magnet coupled to one of the first rail or the second rail, and a receiver coupled to the other of the second rail or the first rail, the receiver configured to form a magnetic connection with the magnet.

The invention provides, in another aspect, a method of adjusting and retaining consecutive rails of a covering for an architectural opening that includes adjusting a position of a second rail in relation to a first rail, the second rail being adjustably connected to the first rail by a first lift cord, retaining the second rail relative to the first rail by contacting a receiver carried by one of the second rail or the first rail to a magnet carried by the other of the first rail or the second rail to form a magnetic connection between the first and second rails, and adjusting a position of a third rail in relation to the first rail and the second rail, the third rail being adjustably connected to the first rail by a second lift cord, wherein adjusting the position of the third rail occurs while the first and second rails maintain the magnetic connection.

Other features and aspects of the invention will become apparent by consideration of the following detailed description and accompanying drawings.

Figure 1:
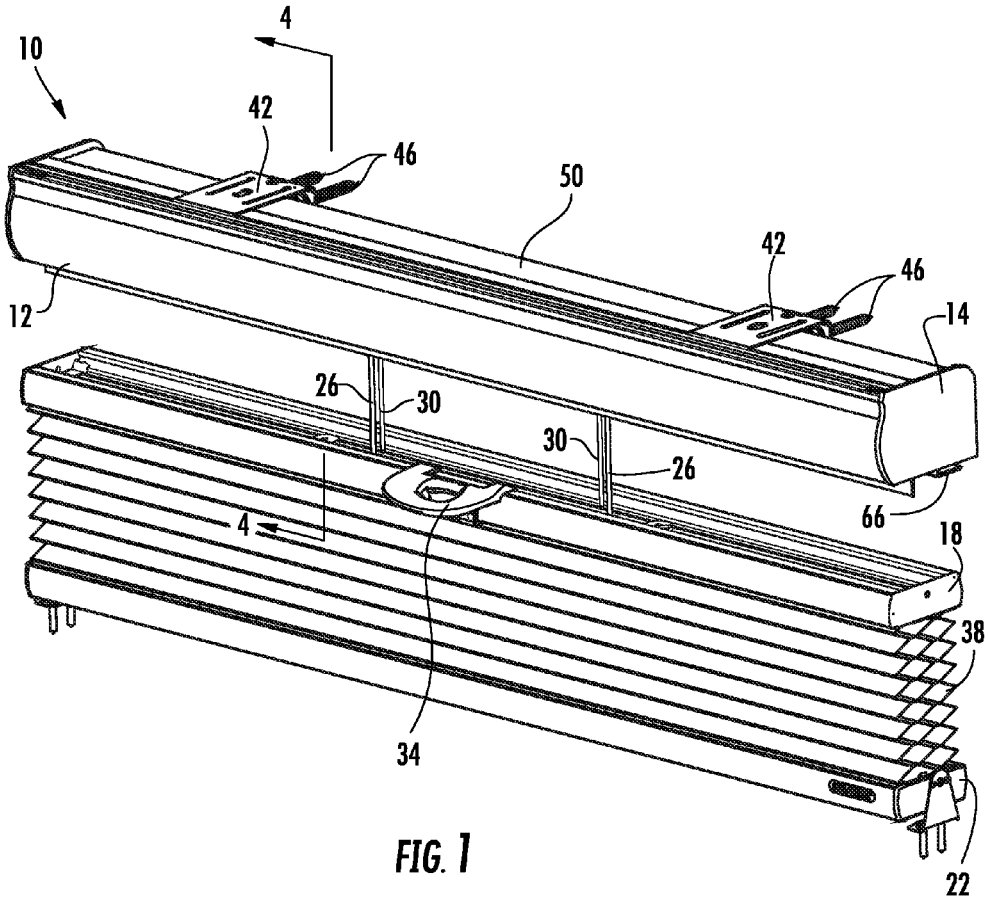
FIG. 1 is a perspective view of a first side of a covering for an architectural opening in accordance with an embodiment of the invention.

Before any embodiments of the present invention are explained in detail, it should be understood that the invention is not limited in its application to the details or construction and the arrangement of components as set forth in the following description or as illustrated in the drawings. The invention is capable of other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

The invention illustrated in the figures and disclosed herein is generally directed to a retention system for a covering 10 for an architectural opening. The covering 10 includes an intermediate rail 18 and a bottom rail 22 that are separately adjustable relative to a head rail 14. A magnetic connection is provided between the head rail 14 and an intermediate rail 18. The magnetic connection is sufficient to maintain a connection between the head rail 14 and the intermediate rail 18 during repositioning of a bottom rail 22 yet can be easily disconnected to allow for repositioning of the intermediate rail 18 relative to the head rail 14.

For ease of discussion and understanding, the following detailed description will refer to an architectural opening and a window. It should be appreciated that the architectural opening can include any suitable opening in a building or other structure, such as a window, a door, a skylight, an open air opening, etc. In addition, the detailed description will refer to a window, which is provided for ease of understanding of the invention. The term window should be construed to include not only a window, but any other architectural opening that the invention disclosed and claimed herein can be used to selectively cover.

FIG. 1 illustrates an example of the covering 10 for an architectural opening, and specifically a window covering or a window shade 10, as view from a first side or front side or user facing side 12. The window covering 10 includes a plurality of rails 14, 18, 22. The intermediate rail or mid rail or second rail 18 is adjustably connected to the head rail or first rail 14 by a first lift cord 26. The bottom rail or third rail 22 is adjustably connected to the head rail 14 by a second lift cord 30. The first lift cord 26 extends from the head rail 14 to connect to the intermediate rail 18, while the second lift cord 30 extends from the head rail 14 through the intermediate rail 18 to connect to the bottom rail 22. The first lift cord 26 is illustrated as a pair of first lift cords 26, while the second lift cord 30 is illustrated as a pair of second lift cords 30. In other examples, a single lift cord, a plurality of lift cords, or three or more lift cords 26, 30 can respectively connect the head rail 14 to the intermediate rail 18, and the head rail 14 to the bottom rail 22.

A handle 34 is mounted to the intermediate rail 18 to facilitate user movement of the intermediate rail 18 relative to the head rail 14. In addition, a window shade or covering material 38 extends between the intermediate rail 18 and the bottom rail 22. More specifically, the material 38 is connected at one end to the intermediate rail 18, and at an opposite end to the bottom rail 22. In the illustrated embodiment, there is no material positioned between the intermediate rail 18 and the head rail 14. The illustrated window shade 10 is referred to as a "bottom-up top-down" (or a "top-down bottom-up") shade, as the shade can be operated from the top down or from the bottom up. This type of shade provides privacy by covering a portion of a window with the covering material 38 that extends between the intermediate rail 18 and the bottom rail 22 (e.g., the bottom-up portion), while also providing selective access to natural light by providing no material between the intermediate rail 18 and the head rail 14 (e.g., the top-down portion). The covering material 38 is illustrated as a cellular fabric, and more specifically a double-cell cellular fabric. In other examples, the covering material 38 can be a pleated fabric, Venetian blinds, Roman shades, natural material (e.g., bamboo, etc.), or any other suitable window treatment or material that is configured to cover a window, limit, reduce, or block light, or otherwise serve as a shade. It should be appreciated that the window shade 10 is not limited to a "bottom-up top-down" shade, and can be any suitable shade having a plurality of rails 14, 18, 22 (e.g., a "sun-up, sun-down" shade, a shade that includes material 38 between the head rail 14 and intermediate rail 18, and between the intermediate rail 18 and the bottom rail 22, etc.).

The head rail 14 is configured to be attached to a surface on or near the window in order to mount the window shade 10 in relation to the window. For example, the head rail 14 can be attached to a wall adjacent a window, a ceiling above a window, or at various positions on the window. A plurality of mounting brackets 42 engage the head rail 14, while a plurality of fasteners 46 (e.g., screws, etc.) attach each mounting bracket 42 to the surface. With the head rail 14 secured to the surface, it does not move in relation to the window. Instead, the intermediate rail 18 and the bottom rail 22 are configured to move in relation to the window and the head rail 14 (or be repositioned relative to the head rail 14). The head rail 14 also includes a removable cover 50 that selectively provides access to an internal chamber defined by the head rail 14, and which contains components that facilitate movement of the lift cords and that maintain the selected positioning of the intermediate rail 18 and bottom rail 22.

Figure 2:
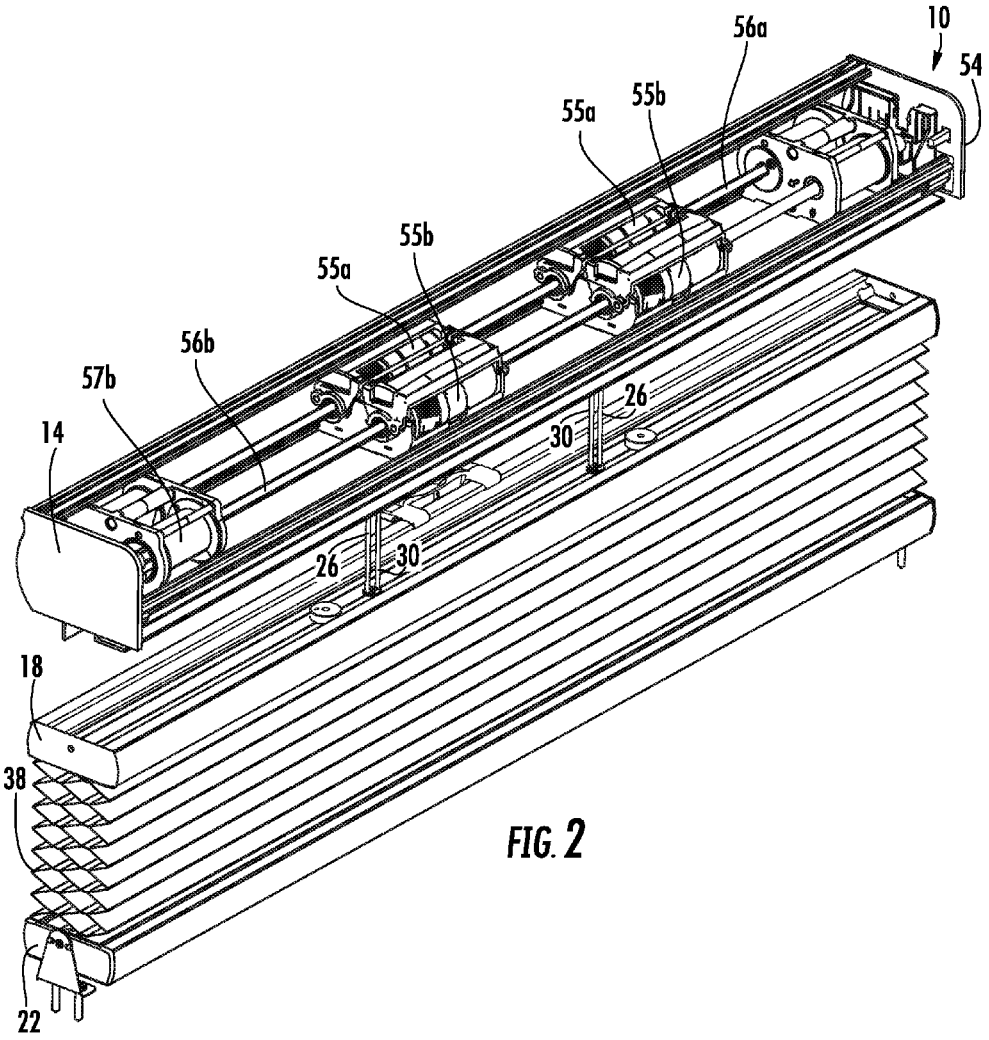
FIG. 2 is a perspective view of a second, opposite side of the covering of FIG. 1 with a head rail cover removed to illustrate components positioned therein.

FIG. 2 illustrates the window shade 10 as viewed from a second side or back side or window facing side 54. In FIG. 2, the head rail cover 50 is removed to illustrate components contained in the head rail 14. The first lift cords 26, which connect the intermediate rail 18 to the head rail 14, each engage a respective winding drum 55*a*. The winding drums 55*a* are carried by a common drive shaft 56*a*. A spring motor 57*a* is attached to the drive shaft 56*a*. The second lift cords 30, which connect the intermediate rail 18 to the head rail 14, each engage a respective winding drum 55*b*. The winding drums 55*b* are carried by a common drive shaft 56*b*. A spring motor 57*b* is connected to the drive shaft 56*b*. In operation, as the rail 18, 22 is positioned closer to or further away from the head rail 14, the respective winding drums 55*a*, 55*b* winds or unwinds the associated lift cords 26, 30. The winding drums 55*a*, 55*b* are configured to rotate the attached drive shaft 56*a*, 56*b* clockwise or counterclockwise, depending on the direction of movement of the rail 18, 22. The spring motors 57*a*, 57*b* apply torque (or tension) to the respective drive shaft 56*a*, 56*b* to facilitate winding (or unwinding) of the winding drums 55*a*, 55*b*, while also assisting to maintain the selected position of the associated rail 18, 22. Applications 62/110,781, 62/110,795, and 62/110,809 provide additional disclosure regarding the components contained in the head rail 14 and operation thereof. These applications are hereby incorporated by reference in their entirety.

Figure 3:
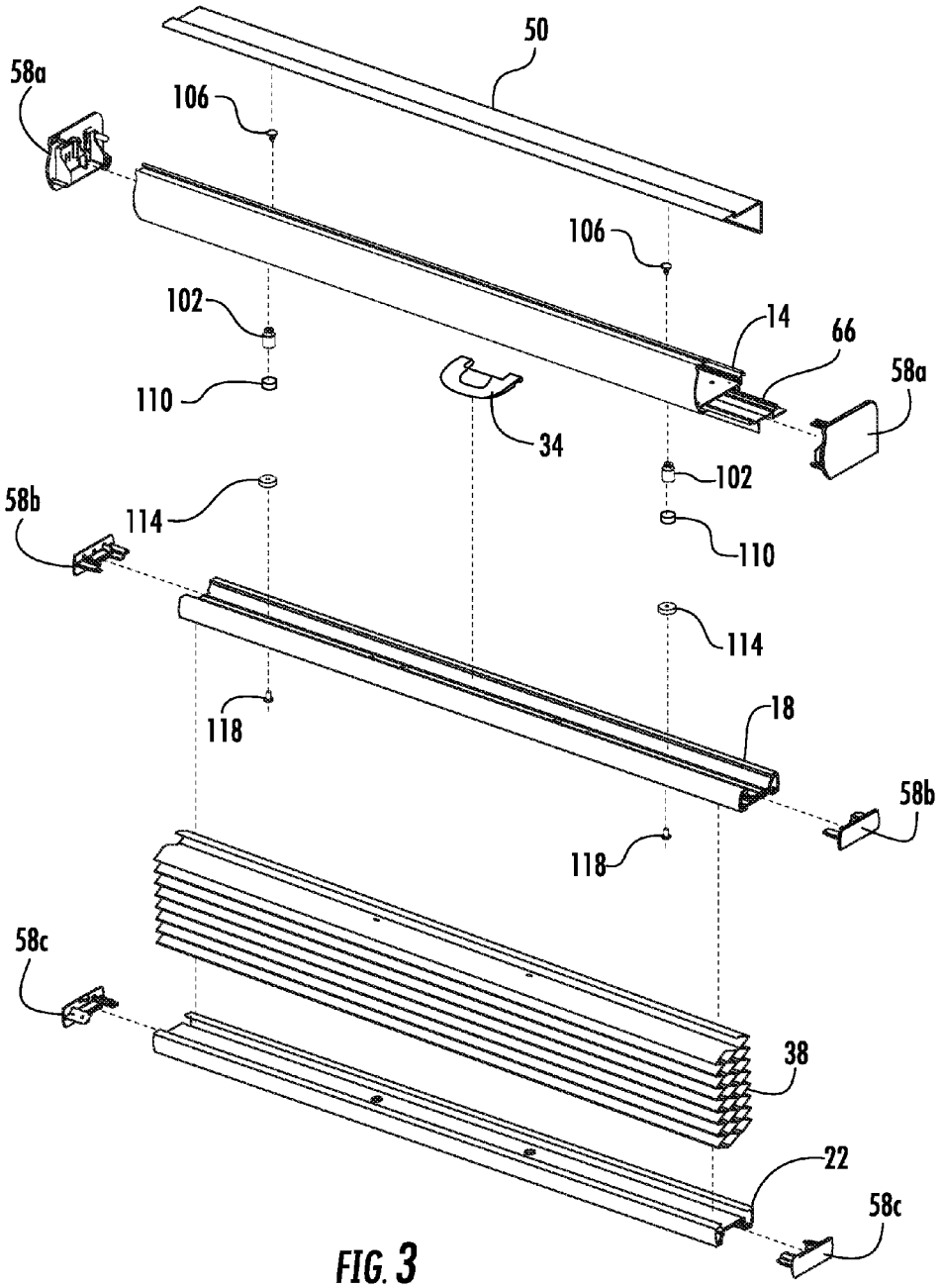
FIG. 3 is a partially exploded view of the covering of FIG. 1, and which does not illustrate the lift cords.

As illustrated in FIG. 3, each rail 14, 18, 22 includes removable end caps 58*a, b, c* that are positioned on opposing ends of each rail 14, 18, 22. The end caps 58 *a, b, c* provide selective access to the ends of each rail 14, 18, 22.

Figure 4:
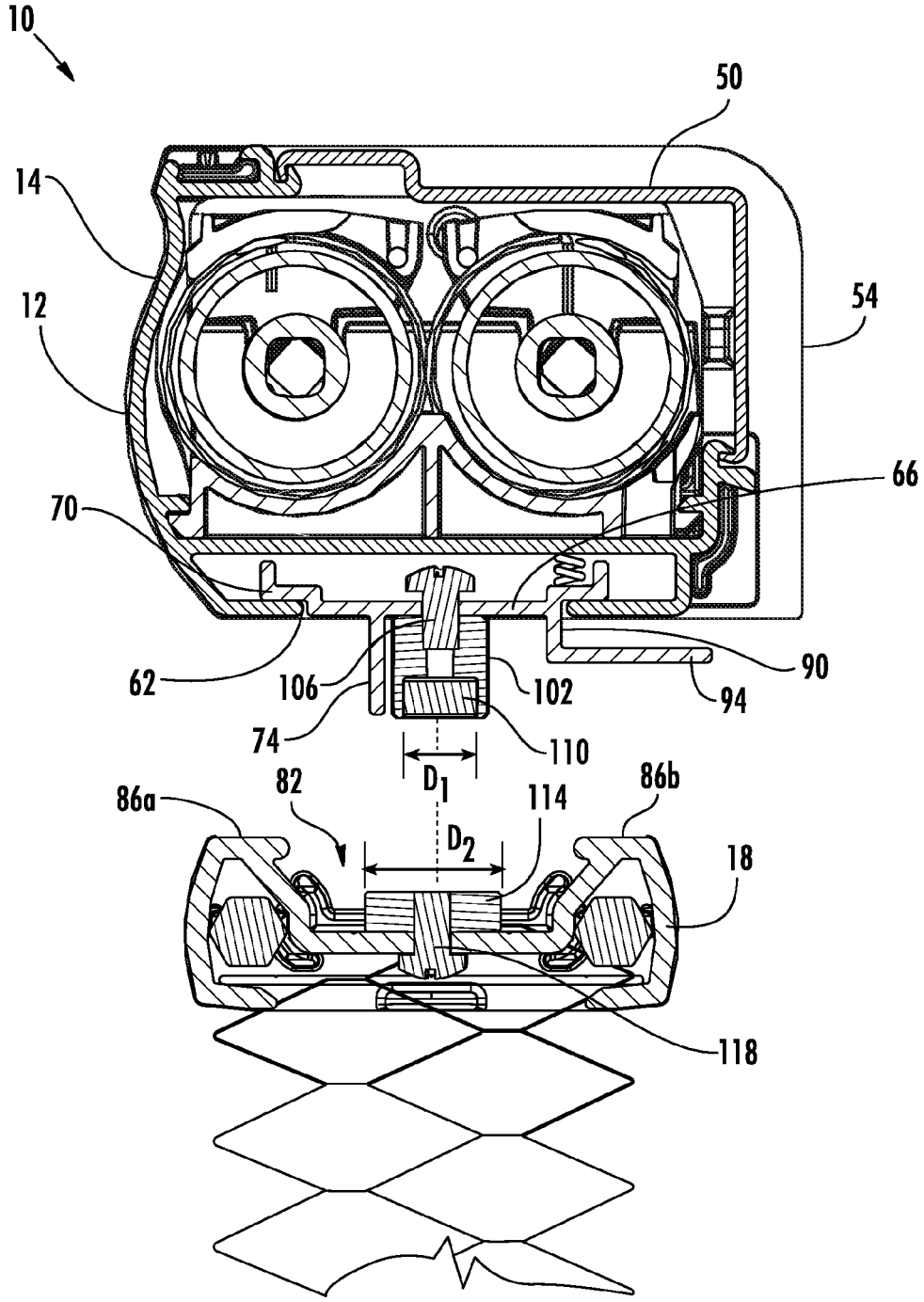
FIG. 4 is a cross-sectional view of the covering of FIG. 1, taken along line 4-4 of FIG. 1, illustrating a magnetic retention assembly in a disengaged configuration.
Figure 5:
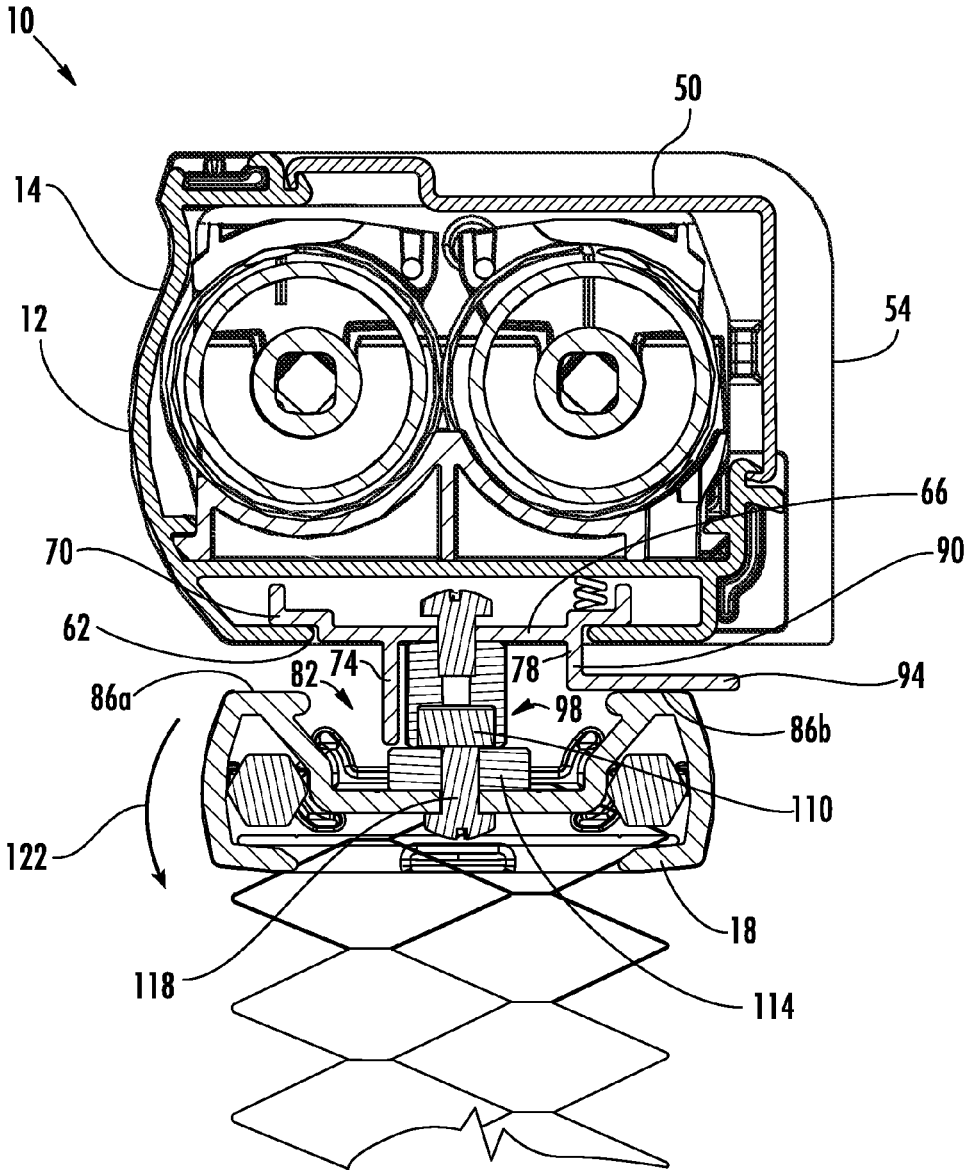
FIG. 5 is the cross-sectional view of the covering of FIG. 4, with the magnetic retention assembly in an engaged configuration.

Referring to FIGS. 4-5, the head rail 14 defines a slot 62 that is configured to receive a head rail insert in the form of a light blocking flange 66. As shown in FIG. 3, the light blocking flange 66 is slidably received by the head rail 14 in the slot 62, as the light blocking flange 66 is illustrated as partially removed from the slot 62. Referring to FIG. 5, a flange body 70 defines the light blocking flange 66. The flange body 70 includes a first or front light blocking lip or member 74, and a second or rear light blocking lip or member 78. The first light blocking lip 74 projects from the head rail 14, towards the intermediate rail 18. More specifically, when the head rail 14 and the intermediate rail 18 are in an engaged configuration (as shown in FIG. 5), the first light blocking lip 74 extends into a channel 82 defined by the intermediate rail 18. The channel 82 is positioned between opposing front and back shoulders 86*a*, 86*b* (or first and second shoulders 86*a*, 86*b*) of the intermediate rail 18 (shown in FIG. 4). The second light blocking lip 78 includes a first portion 90 that projects from the head rail 14 towards the intermediate rail 18, and a second portion 94 that projects from the first portion 90 at an angle to the first portion 90 (and more specifically approximately orthogonal to the first portion 90). When the head rail 14 and the intermediate rail 18 are in the engaged configuration (as shown in FIG. 5), the second portion 94 is configured to overlap or otherwise contact the back shoulder 86*b* of the intermediate rail 18. In the illustrated embodiment, the light blocking lips 74, 78 are provided on opposite sides of a magnetic retention assembly 98. More specifically, the first light blocking lip 74 is positioned on the first or front side 12 of the magnetic retention assembly 98, while the second light blocking lip 78 is positioned on the second or back side 54 of the magnetic retention assembly 98. In other examples, the first light blocking lip 74 can be positioned on the second side 54 of the magnetic retention assembly 98, while the second light blocking lip 78 can be positioned on the first side 12 of the magnetic retention assembly 98. The light blocking lips 74, 78 of the light blocking flange 66 cooperate to reduce light leakage (or otherwise block light) between the head rail 14 and the intermediate rail 18 when in the engaged configuration. Light leakage can be caused by a number of factors, including gravity, manufacturing tolerances, warping of rails, etc. In addition, the light blocking lips 74, 78 cooperate to improve visual concealment of the magnetic retention assembly 98.

Referring now to FIGS. 3-4, the magnetic retention assembly 98 includes a plurality of connection points between the head rail 14 and the intermediate rail 18. The figures illustrate a plurality of connection points (e.g., two connection points). However, in other examples one connection point, or three or more connection points can be used to selectively connect (and retain) the intermediate rail 18 to the head rail 14. Each connection point includes a retainer or cup 102 that is secured to the head rail 14 by a first fastener 106 (e.g., bolt, screw, etc.). The first fastener 106 is in a threaded engagement with the retainer 102, and is configured to connect the retainer 102 to the head rail 14. A magnet 110 is received (and retained) by the retainer 102. A receiver or plate 114 is secured to the intermediate rail 18 by a second fastener 118 (e.g., bolt, screw, etc.). The receiver 114 is positioned in the channel 82, and is recessed within the intermediate rail 18. The second fastener 118 is in a threaded engagement with the receiver 114, and is configured to connect the receiver 114 to the intermediate rail 18. The receiver 114 is generally formed of a material that magnetically attracts to the magnet 110 (e.g., a metallic material that can be magnetized, a second magnet having an opposite polarity of the magnet 110 to provide a magnetic connection, etc.). Referring to FIG. 4, the magnet 110 has a first diameter D1, while the receiver 114 has a second diameter D2. The second diameter D2 is larger than the first diameter D1 to provide a greater surface area for the magnetic connection with the magnet 110. While the magnet 110 and associated retainer 102 are shown attached to the head rail 14, in other examples the retainer 102 and magnet 110 can be attached to the intermediate rail 18, with the receiver 114 attached to the head rail 14. Stated another way, the retainer 102 and the magnet 110 can be attached to one or the head rail 14 or intermediate rail 18, and the receiver 114 can be attached to the other of the intermediate rail 18 or the head rail 14. In addition, while the illustrated embodiment depicts the magnetic retention assembly 98 as between the head rail 14 and the intermediate (mid) rail 18, in other embodiments the retention assembly 98 can be positioned between any two consecutive rails (e.g., the intermediate rail 18 and the bottom rail 22, etc.).

The magnetic retention assembly 98 provides a selective, removable connection between consecutive rails 14, 18. The connection between consecutive rails 14, 18 is sufficient to be maintained while allowing a third rail 22 to be adjusted in relation to the consecutive rails 14, 18. In operation, to form the connection between rails 14, 18, a user adjusts the intermediate (or second) rail 18, moving it towards the head (or first) rail 14 until the magnet 110 engages the receiver 114. In the illustrated embodiments, the magnet 110 is received by the channel 82 of the intermediate (or second) rail 18 and positioned in contact (or engagement) with the receiver 114 to form the magnetic connection. Once the magnetic connection is formed, the magnetic retention assembly 98 is in the first or engaged configuration (shown in FIG. 5). The user can then adjust the position of the bottom (or third) rail 22 (shown in FIGS. 1-3) in relation to the head (or first) rail 14 and the intermediate (or second) rail 18, while maintaining the connection between the head (or first) rail 14 and the intermediate (or second) rail 18. It should be appreciated that the second light blocking lip 78 assists with unintentional disengagement of the magnetic connection. More specifically, the second light blocking lip 78 contacts the intermediate (or second) rail 18 at the back shoulder 86*b* (see FIG. 5). By contacting the second light blocking lip 78, the intermediate (or second) rail 18 has increased stability to assist with maintaining the magnetic connection. Stated another way, the magnetic connection is less likely to disengage from unintentional rocking or movement of the intermediate (or second) rail 18.

Referring to FIG. 5, to disengage the magnetic connection, a user applies a downward force 122 against the intermediate (or second) rail 18. The force is sufficient to overcome the magnetic connection between the magnet 110 and the receiver 114, disconnecting or separating the magnetic connection. Once separated, the magnetic retention assembly 98 is in a disengaged configuration (shown in FIG. 4). In this configuration the intermediate (or second) rail 18 is free to be adjusted or positioned in relation to the head (or first) rail 14.

In other embodiments, the user can pivot the intermediate (or second) rail 18 in relation to the head (or first) rail 14. The user can apply a downward force 122 against a front shoulder 86*a* of the intermediate (or second) rail 18. The front shoulder 86*a* is spaced apart from the head (or first) rail 14 in the engaged configuration. The back shoulder 86*b*, which is in contact with the second portion 94 of the second light blocking lip 78, acts as a fulcrum. The intermediate (or second) rail 18 pivots about the fulcrum until the magnetic connection between the magnet 110 and the receiver 114 is separated (or disconnected). The fulcrum provides a mechanical advantage to facilitate separation of the magnetic connection (e.g., approximately a two-to-one mechanical advantage, etc.).

Various features and advantages of the invention are set forth in the following claims.

What is claimed is:

1. A covering for an architectural opening comprising:

a first rail;

a second rail adjustably connected to the first rail, the second rail defining a first shoulder, a second shoulder, and a channel that is positioned between the first and second shoulders;

a light blocking flange coupled to the first rail, the light blocking flange defining a first light blocking member and a second light blocking member, the first light blocking member being spaced apart from the second light blocking member; and a magnetic retention assembly configured to removably connect the first and second rails, the magnetic retention assembly comprising:

a magnet coupled to one of the first rail or the second rail; and a receiver coupled to the other of the second rail or the first rail, the receiver is configured to form a magnetic connection with the magnet, wherein in response to the magnet contacting the receiver, the first light blocking member extends into the channel, and the second light blocking member does not extend into the channel.

2. The covering of claim 1, wherein the second rail is adjustably connected to the first rail by a first lift cord, and further comprising a third rail adjustably connected to the first rail by a second lift cord, the third rail connected to the second rail by a covering material.

3. The covering of claim 1, further comprising a retainer coupled to one of the first rail or the second rail, the magnet received by the retainer.

4. The covering of claim 1, wherein the covering is a top-down bottom-up shade.

5. The covering of claim 1, wherein the receiver is positioned in the channel defined by the second rail.

6. The covering of claim 1, wherein the receiver is configured to form the magnetic connection with the magnet in response to the magnet contacting the receiver.

7. The covering of claim 1, wherein the first and second light blocking members are positioned on opposite sides of the magnetic retention assembly.

8. The covering of claim 1, wherein the covering includes a first side and a second side, and in response to the magnet contacting the receiver, the first light blocking member is positioned on the first side of the magnetic retention assembly, and the second light blocking member is positioned on the second side of the magnetic retention assembly.

9. The covering of claim 8, wherein the magnet is positioned between the first and second light blocking members.

10. The covering of claim 1, wherein the second light blocking member includes a first portion that projects away from the first rail towards the second rail, and a second portion that angularly projects away from the first portion.

11. The covering of claim 10, wherein the second portion is orthogonal to the first portion.

12. The covering of claim 10, wherein in response to the magnet contacting the receiver, the second portion contacts the second shoulder that is defined by the second rail.

13. The covering of claim 1, wherein in response to the magnet contacting the receiver, the second light blocking member contacts the second shoulder.

14. The covering of claim 13, wherein the magnet is positioned between the first and second light blocking members.

15. A method of adjusting and retaining consecutive rails of a covering for an architectural opening comprising:

adjusting a position of a second rail in relation to a first rail, the second rail being adjustably connected to the first rail by a first lift cord;

retaining the second rail relative to the first rail by contacting a receiver carried by one of the second rail or the first rail to a magnet carried by the other of the first rail or the second rail to form a magnetic connection between the first and second rails;

forming a light blocking connection between the second rail and the first rail during the retaining step, the light blocking connection including a light blocking flange carried by the first rail, the light blocking flange including a first light blocking member positioned on a first side of the magnetic connection and a second light blocking member positioned on a second side of the magnetic connection, opposite the first side, the first light blocking member extending into a recessed channel defined by the second rail, and the second light blocking member not extending into the recessed channel; and adjusting a position of a third rail in relation to the first rail and the second rail, the third rail being adjustably connected to the first rail by a second lift cord, wherein adjusting the position of the third rail occurs while the first and second rails maintain the magnetic connection.

16. The method of claim 15, further comprising applying a downward force on the second rail to disengage the magnetic connection between the first and second rails.

17. The method of claim 15, further comprising applying a downward force on the second rail to pivot the second rail with respect to the first rail to disengage the magnetic connection between the first and second rails, the pivot occurring at a pivot point defined by an interface of the second light blocking member and a shoulder that is defined by the second rail, the shoulder partially defining the recessed channel.

18. A covering for an architectural opening comprising:

a first rail;

a second rail adjustably connected to the first rail, the second rail defines a channel and at least one shoulder that borders the channel;

a light blocking flange mounted to the first rail, the light blocking flange defines a first light blocking member and a second light blocking member; and a magnetic retention assembly configured to removably connect the first rail to the second rail, the magnetic retention assembly including:

a magnet coupled to one of the first rail or the second rail; and a receiver coupled to the other of the second rail or the first rail, wherein in response to the covering being positioned in a first configuration where the second rail is proximal to the first rail, the first light blocking member extends into the channel of the second rail, the second light blocking member contacts the shoulder of the second rail, and the receiver is configured to form a magnetic connection with the magnet.

19. The covering of claim 18, wherein the at least one shoulder includes a first shoulder and a second shoulder, the first shoulder and the second shoulder bordering opposite sides of the channel, the channel is recessed relative to the first and second shoulders, and the second light blocking member contacts the second shoulder in response to the covering being positioned in the first configuration.

* * * * *